United States Patent [19]

Merrel

[11] Patent Number: 4,493,204

[45] Date of Patent: Jan. 15, 1985

[54] SHAFT STRAIGHTENING PRESS WITH A TRAVELING RAM

[75] Inventor: Richard C. Merrel, Lakewood, Calif.

[73] Assignee: Step Enterprises, El Toro, Calif.

[21] Appl. No.: 459,828

[22] Filed: Jan. 21, 1983

[51] Int. Cl.[3] ..... B21D 9/05

[52] U.S. Cl. ..... 72/389; 72/447; 308/3 A; 269/310

[58] Field of Search ..... 72/389, 20, 24, 385, 72/386, 447; 308/6 R, 3 A, 3 R; 104/98; 105/150, 151, 152, 153, 163; 188/41, 42, 62; 269/902, 296, 310

[56] References Cited

U.S. PATENT DOCUMENTS

| | | | |
|---|---|---|---|
| 227,252 | 5/1880 | Hodges | 269/310 |
| 640,268 | 1/1900 | Campbell | 188/41 |
| 1,381,188 | 6/1921 | Gury | 308/3 A |
| 1,814,841 | 7/1931 | Mosleh | 188/41 |
| 1,837,040 | 12/1931 | Gross | 72/389 |
| 2,336,349 | 12/1943 | Ernst | 72/389 |
| 2,416,048 | 2/1947 | Evans | 72/389 |
| 2,439,902 | 4/1948 | Noel | 72/389 |
| 2,711,205 | 6/1955 | Brown | 72/389 |
| 2,748,829 | 6/1956 | Korenak | 72/389 |
| 2,834,435 | 5/1958 | Vanderbeck | 188/42 |
| 3,891,065 | 6/1975 | Iijima et al. | 188/41 |
| 3,974,779 | 8/1976 | Lindblom et al. | 188/41 |
| 4,203,308 | 5/1980 | Davis | 72/389 |

*Primary Examiner*—Daniel C. Crane
*Assistant Examiner*—David B. Jones
*Attorney, Agent, or Firm*—Fulwider, Patton, Rieber, Lee & Utecht

[57] ABSTRACT

A shaft straightening press including a movable carriage which moves along the length of an "I" beam frame and includes a hydraulic ram used for straightening a shaft placed upon the "I" press bed. The carriage rides upon the lower flange of the "I" beam by means of four wheels fixed to the carriage and making rolling contact with the upper surface of the lower flange. The carriage is locked into place by a pair of hydraulic jacks which lift the carriage, thereby disengaging each of the wheels from rolling contact with the lower flange. The carriage has a cross-sectional shape of a rectangular frame so that when the hydraulic jacks are lifted, the lower end of the rectangular frame of the carriage contacts the lower surface of the lower flange of the "I" beam, thereby securely locking the frame-shaped carriage in place. Slideable precision roller blocks and V-blocks are provided on the upper flange of the "I" beam for positioning and orienting the shaft to be straightened. The V-blocks include a means whereby each V-block is disengaged when unloaded to facilitate its horizontal displacement on the "I" beam and is frictionally engaged with the press bed when loaded, thereby substantially fixing the V-block in place.

12 Claims, 9 Drawing Figures

FIG. 3
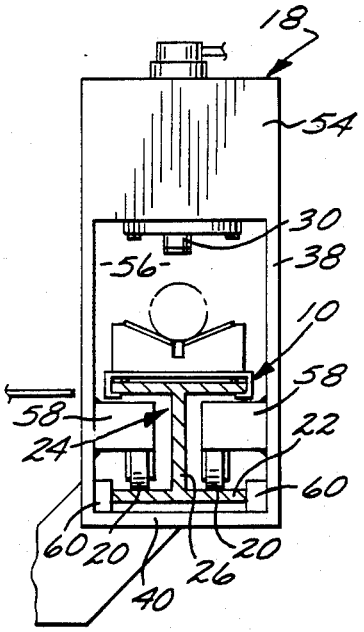
FIG. 4
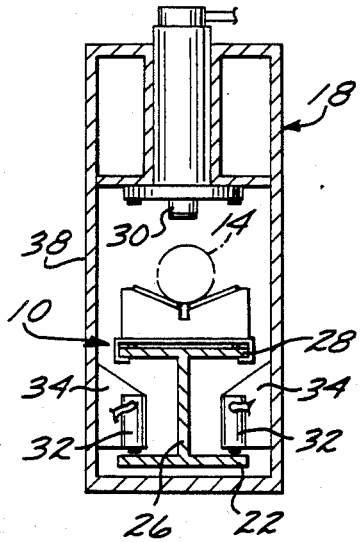
FIG. 5
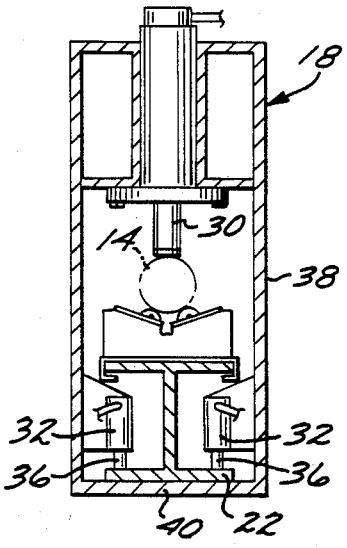
FIG. 6
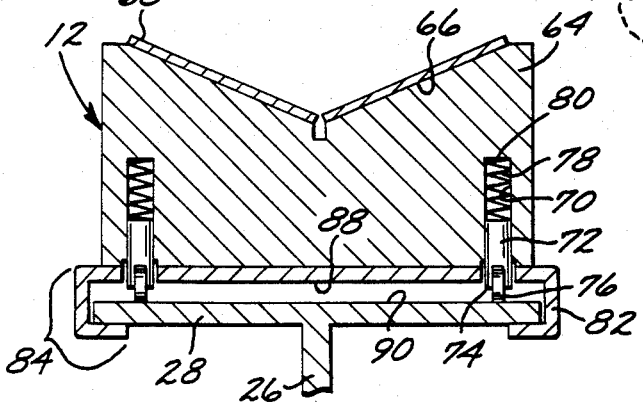
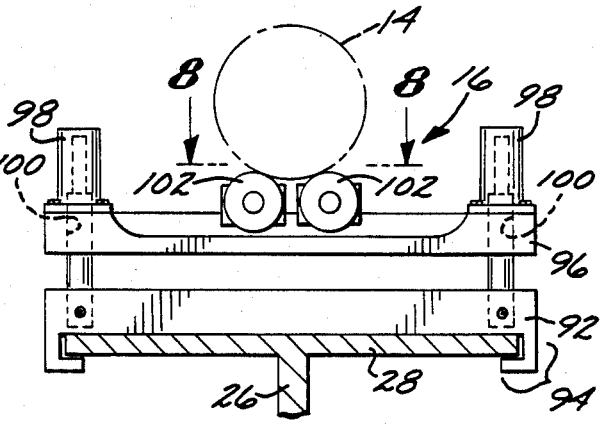
FIG. 7
FIG. 8
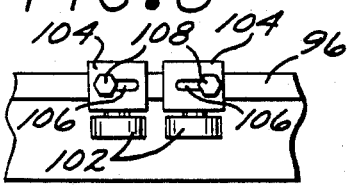
FIG. 9
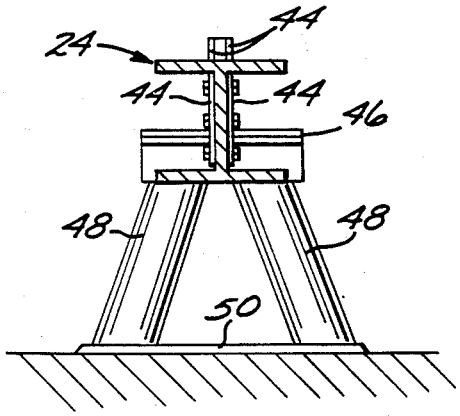

SHAFT STRAIGHTENING PRESS WITH A TRAVELING RAM

BACKGROUND OF THE INVENTION

1. Field of the Invention

The present invention relates to the field of presses, and in particular, relates to improvements within a shaft straightening press.

2. Description of the Prior Art

Shafts and heavy machinery, such as turbines, generators, and other types of heavy equipment are subjected to extremely high stresses over long operational cycles. As a result, such shafts may become bent or run out-of-true. Very often, if such a shaft is out-of-true by 5,000ths of an inch or more, it may cause excessive wear of the shaft or of other machinery, and may cause undesirable vibrations and degradation of performance of the machinery. However, such a shaft can be brought into alignment by the precise exertion of large amounts of force in a shaft straightening press.

One such press is shown by Ernst, "Shaft Straightening Press," U.S. Pat. No. 2,336,349. Presses of this type include shaft stands which are movable in a horizontal direction and include supporting blocks, which hold the shaft to be straightened during the straightening operation, which blocks are movable in a horizontal as well as the vertical direction. Ernst includes a movable carriage which can be translated down the bed of the press. An actuating ram is included within the carriage and thus can be brought to bear against the shaft where desired. However, Ernst employs a complex system using rack and pinion gearing to drive the carriage along the bed by means of rollers rolling on rails rigidly connected to the press bed. Similarly, the supporting blocks are coupled to the press bed through similar rack and pinion gearing system. The result is that a press of the type shown by Ernst is expensive to manufacture and requires continual maintenance to ensure its smooth operation. Furthermore, the movable carriage is locked to the bed only by locking the carriage to the rack and pinion gear system. This adds additional costs and complexity to the mechanism. Moreover, gearing systems are always characterised by the existence of backlash which is particularly true in the case of heavy-duty gearing systems which must bear the types of stresses found in a press of this type. Such backlash becomes further aggravated over the course of time with wear.

Therefore, what is needed is a design for a shaft straightening press which is simple to manufacture, which maintains the precision of its operation without the need for complex gearing systems, and which is not subject to substantial degradation of the precision of its operation due to normal wear and tear.

BRIEF SUMMARY OF THE INVENTION

The present invention is a shaft straightening press which includes: a bed; a pair of V-blocks slidingly engaging the bed and supporting a shaft placed on the V-blocks which shaft is to be straightened in the press; a pair of precision roller blocks slidingly engaging said bed wherein the precision roller blocks are selectively adjustably in a vertical direction with respect to the bed; and a movable carriage slidingly mounted on the bed and disposed between each pair of precision roller blocks and the pair of V-blocks, wherein the movable carriage includes a ram for selectively contacting and exerting a force on the shaft to be straightened. The improvement of the present invention comprises a first mechanism connected to the moveable carriage for translating the carriage in a generally horizontal direction on the bed so that the movable carriage in the rim can be selectively positioned with respect to the shaft which is disposed in a fixed position on the bed. In addition, a second mechanism is provided for fixing the movable carriage with respect to the bed and disabling the first mechanism. As a result of this combination, the carriage is moved to a selected position by the first mechanism and fixed in position by the second mechanism in preparation for the actuation of the ram. The first mechanism is then disabled by the second mechanism.

In particular, the first mechanism includes a plurality of wheels which are connected to the movable carriage. The bed includes an "I" beam which has two generally horizontally disposed flanges and a vertical central web which connectes the flanges. The plurality of wheels run on the lowermost flanges of the "I" beam. The V-blocks and precision roller blocks are slideably disposed on the uppermost one of the flanges.

Further, the second mechanism of the present invention includes a pair of hydraulic jacks which are disposed on opposite sides of the "I" beam and which are actuated to lift the carriage upwardly, thereby removing the wheels from operatable engagement with a lowermost flange of the "I" beam. The carriage is then positioned in a configuration in preparation for actuation of the ram.

The invention is further improved by incorporating within each of the V-blocks, a mechanism for automatically lifting the V-blocks away from the bed when the V-blocks are not loaded by the shaft and for lowering the V-blocks into contact with the bed when the shaft is disposed on them.

These improvements of the present invention allow measurements to be accurately made upon the shaft while the shaft remains in the press; eliminates lengthy set-up times associated with moving the shaft and press, since the shaft is left stationary in the press and the carriage is moved with respect to the shaft; and allows the press to be quickly adapted for use with shafts of varying lengths and diameter. The improvements are better understood by viewing the following Figures in light to the Detailed Description of the Preferred Embodiments.

BRIEF DESCRIPTION OF THE DRAWINGS

FIG. 3 is a sectional view of the press taken through line 3—3 of FIG. 1.

FIG. 4 is a sectional view of the press taken through line 4—4 of FIG. 1.

FIG. 5 is the sectional view of FIG. 4 illustrating the actuation of the pair of jacks connected to the movable carriage.

FIG. 6 is a sectional view in enlarged scale taken through line 6—6 of FIG. 2.

FIG. 7 is a sectional elevational view in enlarged scale taken through line 7—7 of FIG. 2.

FIG. 8 is a partial plan view taken through line 8—8 of FIG. 7.

FIG. 9 is a sectional view taken through line 9—9 of FIG. 1.

DETAILED DESCRIPTION OF THE PREFERRED EMBODIMENTS

Figure 1:
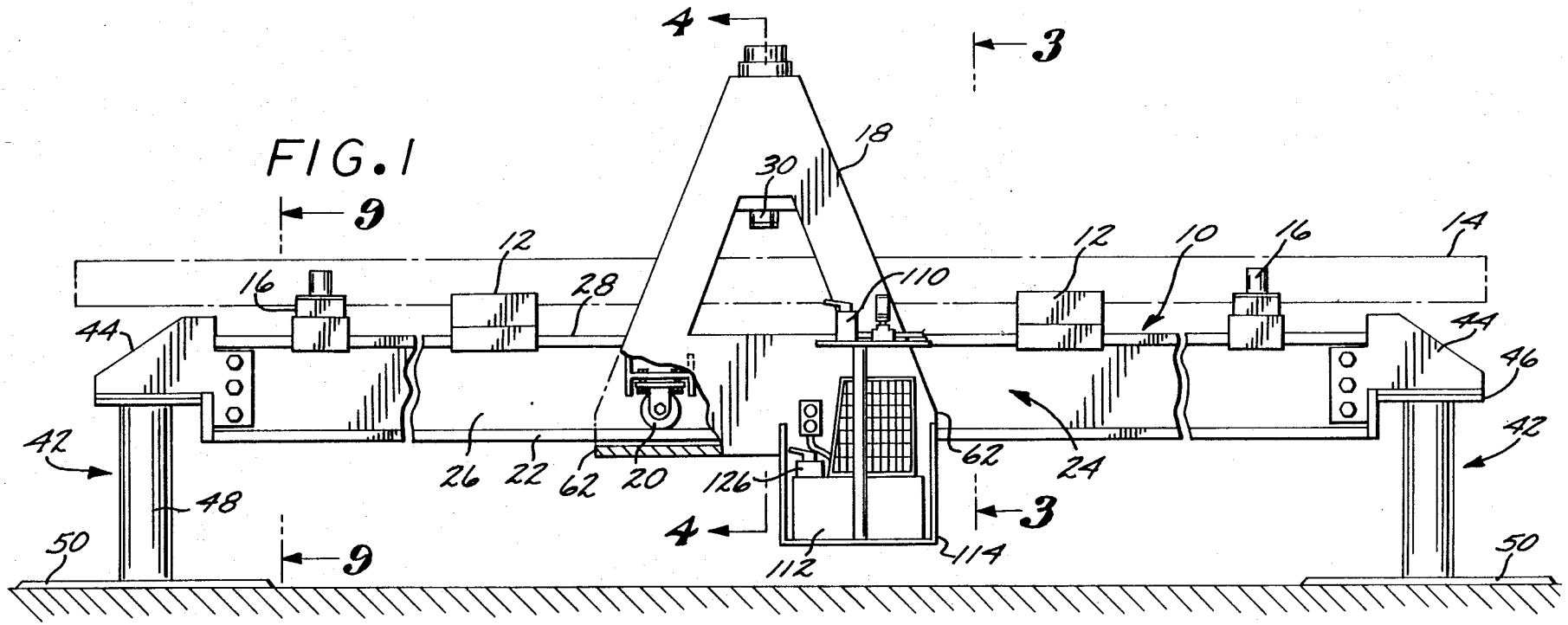
FIG. 1 is a side elevational view of the shaft straightening press.

A shaft straightening press improved according to the present invention is illustrated in side elevational view in FIG. 1 and is principally comprised of a bed, generally denoted by reference numeral 10, a pair of V-blocks 12 for supporting a shaft 14 to be straightened, a pair of precision roller blocks 16 for precisely positioning shaft 14 during the straightening operation, and a movable carriage 18. As shown in partially cut-away view in FIG. 1, movable carriage 18 is supported by four wheels 20 (one of which is shown) which ride on a lower flange 22 of bed 10. Bed 10 includes an "I" beam 24 characterized by a central web 26, best shown in FIGS. 3–5, and an upper flange 28 and lower flange 22. Turning again to FIG. 1, wheels 20 of carriage 18 ride upon the top surface of flange 22 thereby allowing carriage 18 to be selectively positioned at any point on bed 10, usually between precision roller blocks 16 and V-blocks 12. Carriage 18 includes a conventional hydraulic ram 30 which is brought to bear against shaft 14 in a manner selected according to conventional practices.

The improvement to the present invention is particularly characterized by the inclusion of a pair of hydraulic jacks 32 best illustrated in FIGS. 4 and 5. Each jack 32 is rigidly connected by means of flange 34 to carriage 18. The actuating piston of jack 32 is directed downwardly toward lower flange 22. Carriage 18, as shown in FIGS. 3–5, forms in cross section a rectangular frame through which bed 10 is disposed. Thus, when jacks 32 are actuated as shown in FIG. 5, the actuating piston 36 extends from jack 32 and contacts lower flange 22. This causes rectangular frame 38 of carriage 18 to be drawn upward such that lower side 40 of frame 38 contacts lower flange 22 and wheels 20 are lifted from flange 22 thereby immobilizing carriage 18. When so immobilized, carriage 18 frictionally engages the exterior surface of lower flange 22 through end wall 40. With the application of the large forces exerted by ram 30 upon shaft 14, the pressure brought to bear between the exterior surface of flange 22 and end wall 40 is great. Therefore, it becomes virtually impossible for carriage 18 to slip from its position once jacks 32 have been actuated.

The general structural components and the relation and the operation of the press improved according to the present invention, having now been described, the detailed description of the invention and its various embodiments may be specifically set forth.

Figure 2:
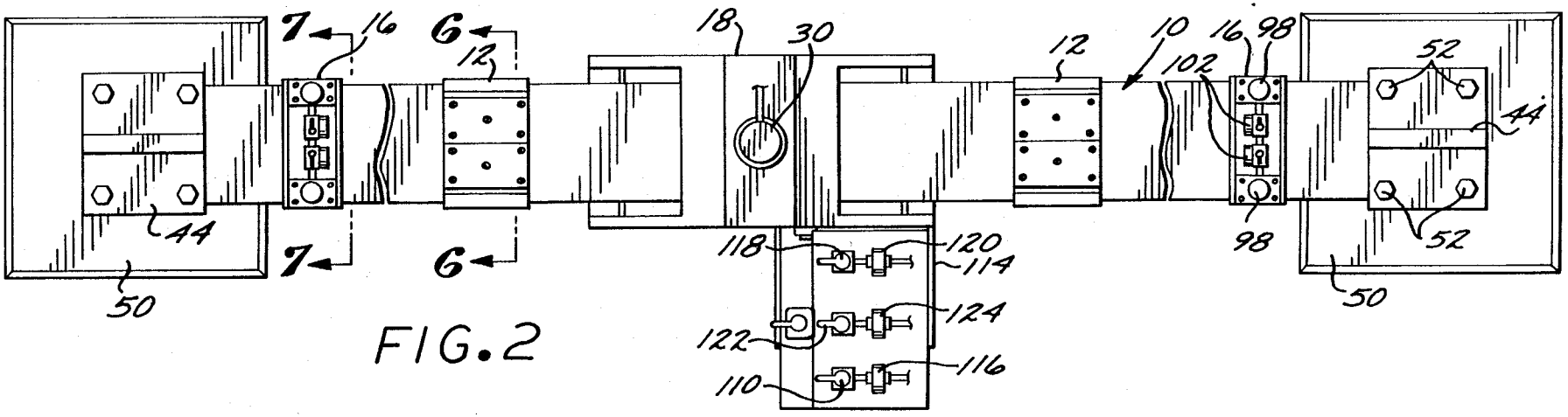
FIG. 2 is a top plan view of the press shown in FIG. 1.

Referring again to FIG. 1, bed 10, includes "I" beam 24 and end stanchions generally denoted by reference numeral 42. "I" beam 24 is securely bolted to fixture 44 at each extremity. Fixture 44 is welded or fixed by other conventional means to plates 46. Plates 46 are, in turn, welded or otherwise affixed to a pair of tubular stanchion legs 48 best seen in FIG. 9 taken through line 9—9 of FIG. 1. Stanchion legs 48 are then welded or affixed to a base plate 50. Referring to FIG. 2, it can be seen that fixture 44 is bolted through four bolts 52 to plate 56 welded to stanchion legs 48.

Carriage 18 as seen in FIG. 1 has a generally triangular side section and is generally shaped like an isosceles triangle. Ram 30 is bolted to the apex of the isosceles or A-shaped carriage 18 as illustrated in FIGS. 3–5. Top portion 54 of carriage 18, as shown in FIG. 3, includes a solid cage for ram 30 while bed 10 extends through an open area 56 defined by the lateral sides of carriage 18 which form frame 38, previously described in connection with FIGS. 4 and 5. As seen in FIG. 3, jack flanges 58 are welded to the lower portions of frame 38 and extend inwardly toward web 26 of "I" beam 24. Wheels 20 are coupled to flanges 58 on each side of web 26 and ride on the upper surface of lower flange 22 of "I" beam 24. A guide block 60 is affixed to each side of frame 38 on its lower-most corners near end 40 for sliding engagement with the edges of lower flange 22. Thus, carriage 18 and wheels 20 are kept on a predetermined path on the upper surface of flange 22 by means of the sliding engagement between guide blocks 60 and the exterior edges of lower flange 22. A pair of such guide blocks 60 are provided at each end 62 of carriage 18 so that four such blocks maintain the alignment of carriage 18 with respect to bed 10. Although the present embodiment contemplates guide blocks 16 having a precisely machined facing plate affixed thereto for precise sliding engagement with flange 22, equivalent means utilizing a rolling engagement with flange 22 could also be employed.

FIG. 2 illustrates a top plan view of bed 10 of FIG. 1 and better shows the placement of V-blocks 12 and precision roller blocks 16 on bed 10. Consider first the detailed construction of V-blocks 12. As better illustrated in FIG. 6, each V-block 12 includes a body 64 having a V-shaped, machined surface 66 defined on its upper edge. Surface 66 may further be finished with polished flat plates 68 screwed into block 64 to provide a precision alignment surface. Block 64 has four bores 70 defined therein into which an extendable leg 72 is slidingly disposed. Two are shown in FIG. 6 and all four are depicted in plan view in FIG. 2. An extendable leg 72 is rotatably coupled at its exterior end 74 to a roller 76. Bore 70, which is a blind hole, also has a compression spring 78 disposed therein with one end of spring 78 bearing against the blind end 80 of bore 70 with the other end of spring 78 bearing against the upper end of extendable leg 72. Four such springloaded extendable legs and roller combinations are provided for each V-block 12 with one such leg at or near each of the four corners of the block. Rollers 76 make rolling contact against the upper surface of upper flange 28. In addition thereto, V-block 12 has a guide member 82 attached to its lower surface which includes a right-angled bend 84 on the side peripheral edges of member 82 which serve to bend around and clasp the exterior edges of upper flange 28. Member 82 serves to guide the block 12 and maintain V-block 12 centered with respect to the center of bed 10 as well as providing a means for retaining V-block 12 on flange 28 when V-block 12 is unloaded. In other words, extendable legs 72 cause V-block 12 to move upwardly away from flange 28 when V-block 12 is unloaded as shown in the configuration in FIG. 6. Surface 86 of right-angle bend 84 is thus brought to bear against the lower surface of upper flange 28 and thereby limits the extension of legs 72 from bores 70. However, when V-block 12 is loaded by placement thereon of shaft 14, the weight of shaft 14 is sufficient to compress each of the compression springs 78 thereby causing lower surface 88 of member 82 to bear directly against the upper surface 90 of flange 28. The sliding frictional contact between surface 88 of V-block 12 and flange 28 is sufficient to prevent the displacement of V-block 12 from its position on bed 10 when loaded with shaft 14. However, when restored to its unloaded position after shaft 14 is removed, V-blocks 12 automatically lift from bed 10 to the extent permitted by member 82 and can be easily repositioned on bed 10 for the next shaft to be straightened. V-blocks 12 as described in connection with FIG. 6, are used to support shaft 14 while the shaft is first placed on the bed 10 prior or after the straightening operation.

FIG. 7 illustrates precision roller block 16 which is used during the straightening operation to appropriately orient shaft 14 with respect to ram 30. Precision roller block 16 is comprised of a lower member 92 which is in sliding contact with upper flange 28 of bed 10 and includes right-angled bend portions 94 for alignment and engagement of lower member 92 with flange 28. Roller block 16 also includes an upper member 96 which can be vertically displaced with respect to lower member 92 by means of two hydraulic actuators 98 mounted on each side of roller block 16. One end of actuator 98 is fixed in lower member 2 with the other end of actuator 98 is disposed from a mating bore 100 defined in upper member 96. As hydraulic actuator 98 is activated, the length of actuator 98 increases according to conventional means thereby raising upper member 96 away from lower member 92 of roller block 16.

Upper member 96 also has mounted thereon a pair of precision rollers 102. As better seen in top partial view in FIG. 8, precision rollers 102 are rotatably coupled to a block fixture 104. Block fixture 104 in turn has a slot 106 defined therein through which a bolt 108 is disposed. Thus, each precision roller 102 may be moved in a horizontal direction perpendicular to the longitudinal axis of bed 10 to appropriately adjust rollers 102 for differing diameter shafts.

The various elements constituting a shaft straightening press improved according to the present invention having now been described, the general operation of the press can be briefly summarized. Returning to FIGS. 1 and 2, a shaft to be straightened is placed upon V-blocks 12. V-blocks 12 will automatically align the center of shaft 14 with respect to the center of bed 10 and the center of ram 30. Precision roller blocks 16 are then placed under shaft 14 at selected positions and precision rollers 102 adjusted to accomodate the diameter of shaft 14. The weight of shaft 14 is still carried at this point by V-blocks 12 and roller blocks 16 are raised, if necessary, under shaft 14 just to allow for appropriate adjustment of precision rollers 102. Carriage 18 is then manually moved or through appropriate mechanical means disposed in the appropriate position with respect to shaft 14. Hydraulic actuators 98 within precision roller blocks 16 are then actuated by means of a conventional hydraulic valve 110 shown in FIG. 2 included as part of a conventional hydraulic control panel 112 disposed on carrier 114 attached to carriage 18. Valve 110 is coupled to a conventional pressure guage 116 to indicate the operating pressure of the hydraulic circuit associated with precision roller blocks 16. Roller blocks 16 are thus actuated through valve 110 to raise shaft 14 to the appropriate height above bed 10.

Valve 118, shown in FIG. 2, is then manipulated to actuate hydraulic jacks 32 shown in FIGS. 4 and 5. The hydraulic circuit connecting valve 118 with hydraulic jacks 32 is monitored by pressure gauge 120. Carriage 18 is then locked into place in the manner previously described in connection with FIGS. 4 and 5. Shaft 14 and carriage 18 now having been appropriately positioned and locked respectively, ram 30 is activated by means of valve 122, whose hydraulic circuit is monitored by pressure gauge 124. Ram 30 is lowered until it contacts shaft 14 and bends shaft 14 by a predetermined amount according to conventional practice and as measured by conventional micrometers and dials set up on bed 10 and engaging shaft 14. After shaft 14 has been flexed by the desired amount, valve 122 is then manipulated to retract ram 30 thereby removing the pressure from shaft 14.

Controller 112 includes a master valve 126 shown in side view in FIG. 1 which appropriately directs a single source of hydraulic pressure to valves 110, 118, or 122 as selected by master valve 126. Since carriage 18, ram 30, and precision roller blocks 16 are not simultaneously actuated, a single source of hydraulic pressure can be used to power the shaft straightening press according to the present invention, by coupling the source of hydraulic pressure through valve 126 to the appropriate hydraulic circuit, which is then manipulated through its corresponding operational valve.

It must be understood that many modifications and alterations may be made by those having ordinary skill in the art without departing from the spirit and scope of the present invention. The presently illustrated embodiments have been shown only for the purposes of clarification and example and should not be taken as limiting the scope of the following claims.

I claim:

1. An improvement in a shaft straightening press, including a bed, a pair of V-blocks slidably engaging said bed and for supporting a shaft placed on said V-blocks, a pair of precision roller blocks slidably engaging said bed, said precision roller blocks selectably adjustable in a vertical direction with respect to said bed, a movable carriage slidably mounted on said bed and disposed between each one of said pair of precision roller blocks and said pair of V-blocks, said movable carriage including a ram for selectively contacting and exerting a force on said shaft to be straightened, said improvement comprising:

first means connected to said movable carriage for slidably and freely translating said carriage in a generally horizontal direction on said bed so that said movable carriage and ram can be selectively positioned with respect to said shaft disposed in a fixed position on said bed; and elevating means mounted on said carriage and operable to shift said carriage between a lowered position rendering said first means operable and an elevated position disabling said first means whereby said elevating means may be actuated to lower said carriage to render said first means operable so said carriage may be freely translated to move said ram to a selected position relative to said V-blocks, said elevating means then actuated to elevate said carriage to disable said first means to hold said carriage stationary relative to said bed.

2. The improvement of claim 1, wherein said first means includes a plurality of wheels connected to said moveable carriage, said bed including an "I" beam having two generally horizontally disposed flanges and a vertical central web connecting said flanges, wherein said plurality of wheels run on the lowermost one of said flanges and said V-block and precision roller blocks are slidably disposed on the uppermost one of said flanges.

3. The improvement of claim 1, wherein said elevating means includes a pair of hydraulic jacks disposed on opposite sides of said "I" beam and being actuated to lift said carriage upward thereby removing said first means from operable engagement with said bed and positioning said carriage in a configuration in preparation for actuation of said ram, whereby said carriage is fixed in position with respect to said bed.

4. The improvement of claim 2, wherein said elevating means includes a pair of hydraulic jacks disposed on opposite sides of said "I" beam and being actuated to lift said carriage upward thereby removing said first means from operable engagement with said bed and positioning said carriage in a configuration in preparation for actuation of said ram, whereby said carriage is fixed in position with respect to said bed.

5. The improvement of claim 2, wherein said elevating means includes a pair of hydraulic jacks connected to said carriage on each side of side "I" beam, each jack being actuated to bear against said lower flange of said "I" beam, thereby lifting said carriage with respect to said "I" beam and lifting said plurality of wheels from contact with said lowermost flange of said "I" beam thereby fixing said carriage with respect to said "I" beam and preparing said carriage for actuation of said ram.

6. The improvement of claim 1 further comprising third means included within said V-blocks for automatically lifting said V-blocks away from said bed when said V-blocks are not loaded by said shaft and for lowering said V-block in contact with said bed when said shaft is disposed upon said V-blocks.

7. The improvement of claim 6 wherein said third means includes a plurality of rollers, each rotatably coupled to an extendable leg disposed in a bore defined in said V-block, said extendable leg slideable within said bore and resiliently extended therefrom by means of a compression spring disposed in said bore and bearing against the bottom of said bore in said V-block at one end of said compression spring and bearing against an end of said extendable leg at the opposing end of said compression spring.

8. A shaft straightening press comprising:

a stationary bed formed from an "I" beam having an upper and lower flange generally disposed in a horizontal plane connected by a central vertically disposed web, said flanges and web forming said "I" beam;

a pair of precision roller blocks slidably disposed on said upper flange of said bed for selectively adjusting the orientation of a shaft disposed in said press for straightening;

a carriage disposed between said precision roller blocks and movable along the length of said "I" beam, said carriage having a plurality of wheels connected thereto, said plurality of wheels being disposed on each side of said "I" beam and in rolling contact with said lower flange of said "I" beam, whereby said carriage is moved along the length of said "I" beam between said precision roller blocks to a selected position with respect to said shaft disposed on said precision roller blocks;

a ram included within said carriage for contacting and exerting a force on said shaft for straightening said shaft; and a pair of jacks included within said carriage and actuated to lift said carriage so that said plurality of wheels no longer make rolling contact with said lower flange of said "I" beam and so that said carriage is positioned in preparation for actuation of said ram, whereby lengthy set-up time associated with moving said shaft in said press is eliminated by leaving said shaft stationary in said press and by moving said carriage with respect to said shaft, whereby measurements may be accurately made upon said shaft while said shaft remains in said press, and whereby said press can be quickly adapted for use with shafts of varying lengths and diameters.

9. The press of claim 8 further including a pair of V-blocks slideably engaged with said upper flange of said "I" beam, said V-blocks for providing a means for supporting said shaft disposed in said press prior to support of said shaft by said precision roller blocks, said V-blocks including means for selectively providing sliding engagement with said upper flange of said "I" beam when said V-blocks are unloaded and for frictionally engaging said upper flange of said "I" beam when said V-blocks are loaded.

10. The press of claim 9, wherein said means for selectively providing sliding engagement of said V-block with said upper flange of said "I" beam includes a plurality of rollers disposed in rolling contact with said upper flange, each said roller being coupled to an extendable leg, said extendable leg being slideably disposed in a blind bore defined in said V-block, a compression spring being disposed in said bore and having one end bearing against the blind end of said blind bore and the opposing end of said compression spring bearing against said extendable leg thereby urging said extendable leg out of said bore, whereby said V-block is supported above said upper flange when unloaded, thereby making making contact with said upper flange only through rolling contact with said plurality of rollers, and whereby said V-block is forced into full contact with said upper flange when loaded, the weight of said shaft forcing said extendable legs into each corresponding bore so that the bottom surface of said V-block makes full contact with said upper flange of said "I" beam.

11. The press of claim 8, wherein said precision roller blocks include a first and second horizontal member, said first horizontal member being vertically displaceable with respect to said second horizontal member, means for displacing said first horizontal member, and a pair of rollers being slideably coupled to said first horizontal member and being selectively adjustable on said first horizontal member in a horizontal direction perpendicular to the longitudinal axis of said "I" beam, whereby said precision rollers may be selectively adjusted to accommodate varying diameters of a shaft placed thereon.

12. The improvement of claim 1 wherein:

said carriage includes an end wall for engaging said bed when said carriage is shifted to its elevated position by said elevating means to thereby limit further elevation of said carriage relative to said bed.

* * * * *